US007449687B2

(12) United States Patent
Li

(10) Patent No.: US 7,449,687 B2
(45) Date of Patent: Nov. 11, 2008

(54) METHODS AND COMPOSITIONS FOR COMBINING IONS AND CHARGED PARTICLES

(75) Inventor: Gangqiang Li, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 312 days.

(21) Appl. No.: 11/151,875

(22) Filed: Jun. 13, 2005

(65) Prior Publication Data

US 2006/0289741 A1 Dec. 28, 2006

(51) Int. Cl.
*H01J 49/26* (2006.01)

(52) U.S. Cl. ..... 250/293; 250/281; 250/282; 250/283; 250/288; 250/299

(58) Field of Classification Search ..... 250/293, 250/281, 282, 283, 288, 299
See application file for complete search history.

(56) References Cited

U.S. PATENT DOCUMENTS

| | | | | |
|---|---|---|---|---|
| 6,285,027 | B1 | 9/2001 | Chernushevich et al. | |
| 6,570,153 | B1 | 5/2003 | Li et al. | |
| 6,596,989 | B2 * | 7/2003 | Kato | 250/288 |
| 6,737,641 | B2 * | 5/2004 | Kato | 250/281 |
| 6,770,871 | B1 * | 8/2004 | Wang et al. | 250/281 |
| 6,835,928 | B2 * | 12/2004 | Bateman | 250/282 |
| 7,026,610 | B2 * | 4/2006 | Kato | 250/285 |
| 2002/0030159 | A1 * | 3/2002 | Chernushevich et al. | 250/287 |
| 2003/0155498 | A1 * | 8/2003 | Kato | 250/281 |
| 2003/0183759 | A1 | 10/2003 | Schwartz et al. | |
| 2004/0173740 | A1 * | 9/2004 | McLuckey et al. | 250/288 |
| 2005/0199804 | A1 * | 9/2005 | Hunt et al. | 250/290 |

FOREIGN PATENT DOCUMENTS

| | | | |
|---|---|---|---|
| GB | 2392301 | A * | 2/2004 |
| WO | 2005074004 | A | 8/2005 |
| WO | WO2005074004 | A * | 8/2005 |
| WO | 2005083743 | A | 9/2005 |
| WO | WO2005083743 | A * | 9/2005 |
| WO | 2005096342 | A | 10/2005 |
| WO | WO2005096342 | A * | 10/2005 |

OTHER PUBLICATIONS

Syka, et al ("Peptide and protein sequence analysis by electron transfer dissociation mass spectrometry," PNAS vol. 101 No. 26 9528-9533, Jun. 29, 2004).*
Schwartz et al. "A Two-Dimensional Quadrupole Ion Trap Mass Spectrometer," (2002) American Society for Mass Spectrometry, 13:659-669.
Baba et al. "Electron Capture Dissociation In A Radio Frequency Ion Trap," (2004) Anal. Chem., 76:4263-4266.
EP Application 06253017 Search Report dated Feb. 6, 2008.

* cited by examiner

*Primary Examiner*—Jack I. Berman
*Assistant Examiner*—Michael Maskell

(57) ABSTRACT

The invention provides an apparatus for combining ions and charged particles. In general, the apparatus contains: a) a multipole device having an ion exit end; b) a mass analyzer; and c) a source of charged particles. The apparatus is configured so that charged particles produced by the source of charged particles pass through the mass analyzer and into the multipole device via the ion exit end of the multipole device.

6 Claims, 3 Drawing Sheets

METHODS AND COMPOSITIONS FOR COMBINING IONS AND CHARGED PARTICLES

BACKGROUND

Mass spectrometry is an analytical methodology used for qualitative and quantitative determination of chemical compounds in a chemical or biological sample. Analytes in a sample are ionized, separated according to their mass by a spectrometer and detected to produce a mass spectrum. The mass spectrum provides information about the masses and in some cases the quantities of the various analytes that make up the sample. In particular embodiments, mass spectrometry can be used to determine the molecular weight or the molecular structure of an analyte in a sample. Because mass spectrometry is fast, specific and sensitive, mass spectrometer devices have been widely used for the rapid identification and characterization of biological analytes.

Mass spectrometers may be configured in many different ways, but are generally distinguishable by the ionization methods employed and the ion separation methods employed. For example, in certain devices parent analyte ions are isolated, the parent ions are fragmented to produce daughter ions and the daughter ions are subjected to mass analysis. The identity and/or structure of the parent analyte ion can be deduced from the masses of the daughter ions. Such devices, generally referred to as tandem mass spectrometers (or MS/MS devices) may be coupled with a liquid chromatography system (e.g., an HPLC system or the like) and a suitable ion source (e.g. an electrospray ion source) to investigate analytes in a liquid sample.

In certain cases, a parent ion is first selected and then trapped in a collision cell. Fragmentation of the trapped parent ion is achieved by colliding the ion with neutral gas molecules or charged particles (e.g., other positively-charged or negatively-charged ions or electrons) to break covalent bonds within the ion. In these collisional methods, the energy produced by collision of a parent ion and a charged particle is redistributed within the parent ion, and the energy redistribution leads to dissociation (i.e., breakage) of covalent bonds within the parent ion. Covalent bonds having the lowest activation energy are usually broken to produce daughter ions. Such methodologies include collisional induced dissociation (CID) and electron capture dissociation (ECD), which are well known in the art.

Collision cells contain multipole devices and generally contain a plurality of elongated electrodes (e.g., conductive rods that may be hyperbolic or circular in cross-section) that lie parallel to each other and spaced from each other to form an ion passageway. A radio frequency (RF) voltage is applied to the electrodes to produce an oscillating electrical field which holds parent ions within the ion passageway, and charged particles or inert gas are introduced into the ion passageway to facilitate fragmentation of the parent ions. After a parent ion has been fragmented to produce daughter ions, the daughter ions are usually ejected into a mass spectrometer, typically a time of flight mass spectrometer (TOF-MS), a quadrupole mass analyzer or Fourier transform ion cyclotron resonance mass spectrometer (FTICR), for mass analysis. In certain cases, a particular daughter ion may be selected (i.e., filtered away from other daughter ions) in a mass filter, and combined with charged particles to further modify, e.g., fragment or alter the charge of, the daughter ion prior to mass analysis. Accordingly, reaction between ions and charged particles play an important role in many mass spectrometry methods.

Current methods for introducing charged particles into a collision cell involve introducing charged particles radially with respect to the ion passageway (e.g., through a space between two adjacent electrodes, or through a slot in an electrode; see, e.g., Schwartz et al (J. Am. Soc. Mass Spectrom. 2002 13:659-669) and Baba et al (Anal. Chem. 2004 76:4263-4266)). However, these methods for introducing charged particles into a collision cell are less than optimal because the charged particles are generally forced to pass through an RF field. The RF field represents a significant barrier for charged particles to cross, and, accordingly, the vast majority of charged particles are deflected prior to reaching the ion passageway in such methods. Further, passage of a charged particle through an RF field can lead to a significant change in the energy of the charged particle. As such, even if a charged particle makes it through the RF field to the ion passageway, it may have insufficient energy to initiate parent ion cleavage. Current methods for introducing charged particles into a collision cell are therefore inefficient. In certain prior art systems, a slot is constructed in an electrode. The slot causes an undesirable potential distortion within the oscillating multipole field. To achieve maximal performance of a multipole field, such distortion is undesirable.

Accordingly, there is still a great need for new methods for introducing charged particles into a collision cell. This invention meets this need, and others.

SUMMARY OF THE INVENTION

The invention provides an apparatus for combining ions and charged particles. In general, the apparatus contains: a) a multipole device having an ion exit end; b) a mass analyzer; and c) a source of charged particles. The apparatus is configured so that charged particles produced by the source of charged particles pass through the mass analyzer and into the multipole device via the ion exit end of the multipole device. In certain embodiments, the multipole device is present in a collision cell and the charged particles react with ions (e.g., either parent ions or fragmentation products of parent ions) in the collision cell to, for example, facilitate fragmentation or alter the charge of those ions. The ions of the collision cell are then introduced into a mass analyzer for mass analysis. The invention finds use in a variety of analytical methods. For example, the invention finds use in chemical, environmental, forensic, food, pharmaceutical and biological research applications.

DETAILED DESCRIPTION OF THE INVENTION

The invention provides an apparatus for combining ions and charged particles. In general, the apparatus contains: a) a multipole device having an ion exit end; b) a mass analyzer; and c) a source of charged particles. The apparatus is configured so that charged particles produced by the source of charged particles pass through the mass analyzer and into the multipole device via the ion exit end of the multipole device. In certain embodiments, the multipole device is present in a collision cell and the charged particles react with ions (e.g., either parent ions or fragmentation products of parent ions) in the collision cell to, for example, facilitate fragmentation or alter the charge of those ions. The ions of the collision cell are then introduced into a mass analyzer for mass analysis. The invention finds use in a variety of analytical methods. For example, the invention finds use in chemical, environmental, forensic, food, pharmaceutical and biological research applications.

Methods recited herein may be carried out in any logically possible order, as well as the recited order of events. Furthermore, where a range of values is provided, it is understood that every intervening value, between the upper and lower limit of that range and any other stated or intervening value in that stated range is encompassed within the invention.

The referenced items are provided solely for their disclosure prior to the filing date of the present application. Nothing herein is to be construed as an admission that the present invention is not entitled to antedate such material by virtue of prior invention.

Reference to a singular item, includes the possibility that there are plural of the same items present. More specifically, as used herein and in the appended claims, the singular forms "a," "an," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Definitions may occur throughout the Detailed Description of the Invention.

Figure 1:
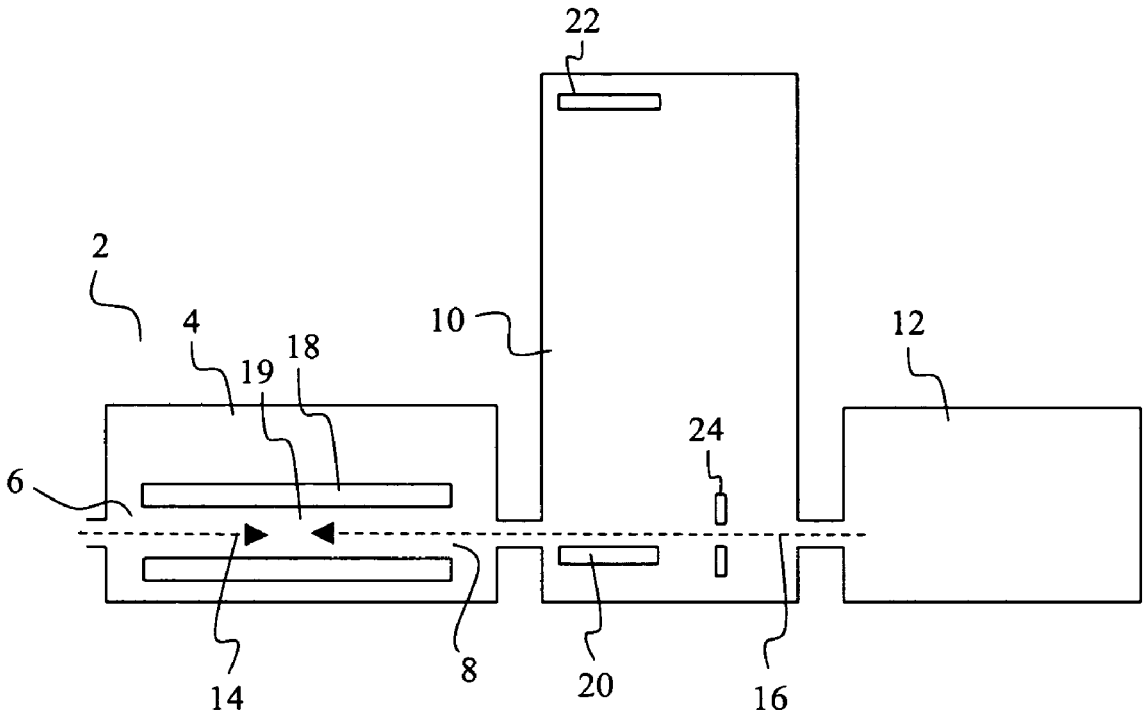
FIG. 1 is a schematic representation of a first exemplary embodiment described in greater detail below.

As mentioned above, the invention provides a method and apparatus for combining ions and charged particles. The general features of the instant apparatus are set forth in FIG. 1. With reference to FIG. 1 and in general terms, an instant apparatus 2 contains a multipole device 4 having an ion entrance 6 and an ion exit 8, a mass analyzer 10 that is connected to the ion exit 8 of multipole device 4, and a source of charged particles 12 that is connected to the mass analyzer 10. The direction of ion movement is shown by dotted arrow 14, and the direction of charged particle movement is shown by dotted arrow 16. As illustrated, the apparatus is configured so that charged particles produced by source of charged particles 12 pass through the mass analyzer 10 and into the multipole device 4 via the ion exit end of the multipole device 8.

As will be described in greater detail below, multipole device 4 generally contains elongated electrodes 18 that define an ion passageway 19 in which ions and charged particles are combined. Depending on the mass analyzer employed, the mass analyzer may contain an ion pulser 20 for directing ions to a detector, and a detector 22 (although not necessarily in the position shown). Mass analyzer 10 may also contain one or more ion optical components 24, e.g., a lens or collimator, for directing charged particles through mass analyzer 10. The subject apparatus may optionally contain further elements (e.g., ion guides, ion optic components, intermediate vacuum chambers, etc.) between the three main elements shown in FIG. 1. For example, as would be apparent to one of skill in the art, the source of charged particles 12 may be connected to mass analyzer 10 via intermediate vacuum chambers that contain ion guides, for example.

The source of charged particles 12 may be any source of ions or electrons and may provide positively-charged ions, negatively-charged ions or electrons. For example, the source of charged particles 12 may be a glow discharge ion source, a laser desorption/ionization ion source, a field ionization ion source, a thermal ionization ion source, a chemical ionization ion source, a photo-ionization ion source or an electron emitter. In one embodiment, therefore, the source of charged particles 12 may be a glow discharge device that provides positive or negative ions, or an emitter of elections (e.g., a tungsten filament). Such sources of charged particles are generally well known in the art, and are readily adapted the methods described herein without undue effort.

Likewise, mass analyzer 10 may be any type of suitable mass analyzer. In representative embodiments, mass analyzer 10 may be a time of flight (TOF) mass analyzer (which term includes reflectron time of flight mass analyzers and other variations thereof), a Fourier transform ion cyclotron resonance (FT-ICR) mass analyzer, an ion trap, or a quadrupole mass analyzer. In certain embodiments, suitable mass analyzers send ions in a direction that is off-axis to the direction in which ions enter the mass analyzer. For example, in a TOF mass analyzer, ions enter the mass analyzer traveling in a first direction and are pulsed in a second direction that is approximately perpendicular to the first direction. Accordingly, in certain embodiments a mass analyzer employed herein may contain pulser 20 (i.e., an electrode device for changing the direction of ions) to facilitate a change in ion direction.

Multipole device 4 may be any type of multipole device that can manipulate (for example, move, e.g., transport, or fragment, store, filter, cool, etc.) ions in a mass spectrometer system. The term "multipole device" is used herein to encompass quadrupole, hexapole, octopole, and 16-pole devices (or similar devices containing other numbers of elongated electrodes), regardless of how those devices may be employed. In one embodiment, the multipole device is a collision cell in which ions are collided with charged particles to facilitate charge reduction, charge transfer, ion-ion reactions, electron capture dissociation, collisional cooling, fragmentation or another physical or chemical process. In another embodiment, the multipole device is an ion guide. Ion traps (including two-dimensional and three-dimensional ion traps as well as linear and non-linear ion traps) may be employed in a collision cell in many embodiments of the invention.

A subject multipole device may contain a plurality of rods (i.e., 2 or more rods, typically an even number of rods, e.g., 4, 6, 8 or 16 or more), longitudinally arranged around a central axis along which ions may be maintained (e.g., trapped) or directionally moved (i.e., from the ion entrance end of the device to an ion exit end of the device) during operation of the device. The term "rod" is used herein to describe a composition that has any cross-sectional shape, e.g., a cross sectional shape that is circular, oval, semi-circular, concave, flat, square, rectangular, hyperbolic, or multisided. Hyperbolic rods are most frequently employed in an ion trap, although any type of rod may be used.

In general, the rods are of a subject multipole device are conductive, and are arranged to provide an ion entrance for accepting ions, an ion exit for ejecting ions, and an ion passageway having a central axis extending from the ion entrance end to the ion exit end. In certain embodiments, the rods may be held in a suitable arrangement by one or more collars, although several alternatives to collars may also be used.

The spacing between consecutive rods is usually the same between all rods of a device, although rod spacing may vary between different devices. In use, the rods are electrically connected so as to provide an alternating radio frequency (RF) field that confines the ions to a region proximal to the ion passageway, and, in certain embodiments, direct current (DC) electric fields that prevent ions from exiting the device from the ends of the device.

Figure 2:
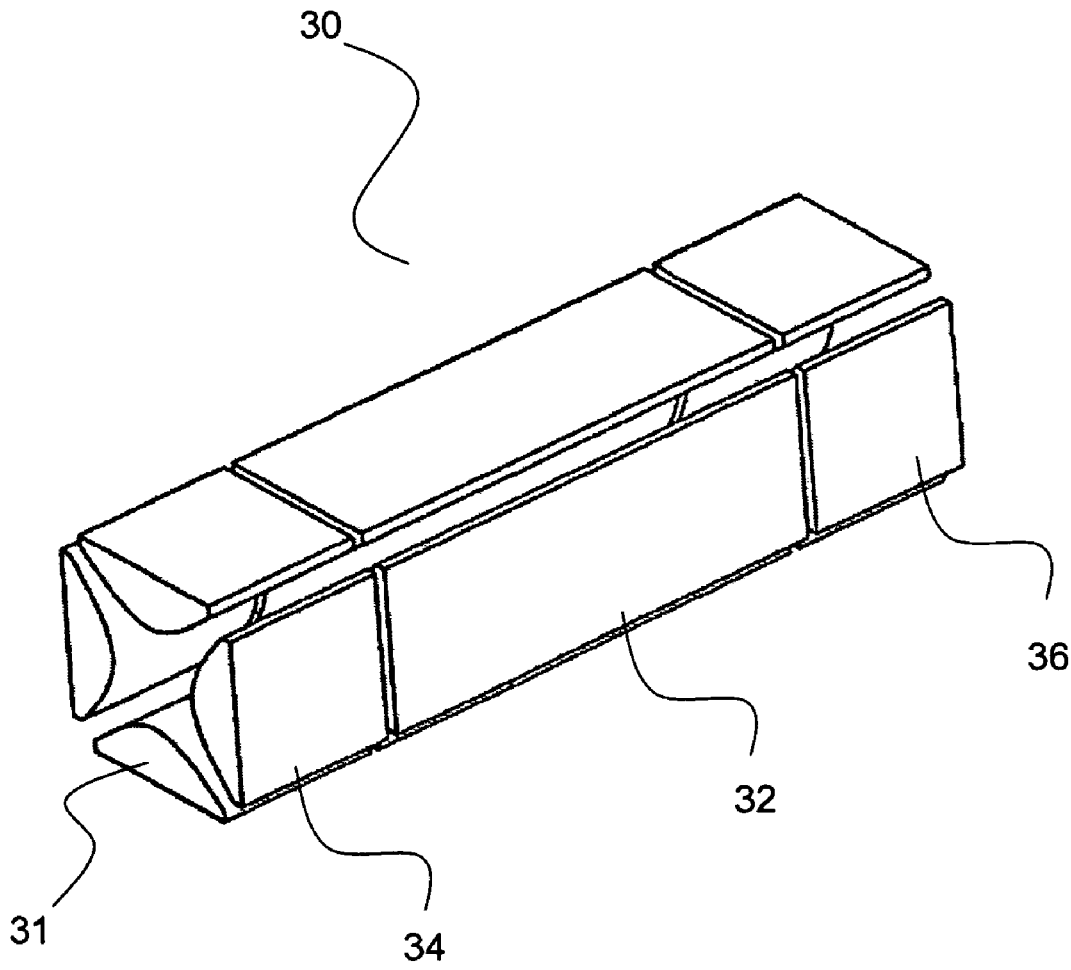
FIG. 2 is a schematic representation of a second exemplary embodiment described in greater detail below.

A subject multipole device may be segmented or unsegmented, and may contain other optical components for maintaining ions within the multipole device. In one embodiment illustrated in FIG. 2, a subject multipole device 30 is an ion trap containing parabolic rods 31 and is segmented into three sections 32, 34, and 36 that are independently connected to different power sources. In an alternative embodiment, a subject multipole device is an ion trap containing parabolic rods and is not segmented. Such a device may contain lenses that form apertured electrode "caps" over the ends of the device to regulate (e.g., prevent or allow) ions from escaping from the central passageway of the device.

In certain embodiments, a DC voltage is applied to the ends of the multipole device (either to the apertured electrode caps or the terminal rod sections, for example, depending on which type of multipole device is used) to prevent ions from exiting the multipole device from the ion entrance and ion exit, and an RF voltage is applied to the rods to generate an RF field that confines the ions within the device. As is known for multipole devices, the RF voltages supplied to every second rod may be 180 degrees out of phase with that supplied to the even numbered rods. In general, an ion-confining RF produced in the multipole device typically has a frequency of 0.1 MHz to 10 MHz, e.g., 0.5 MHz to 5 MHz, and a magnitude of 20V to 10,000 V peak-to-peak, e.g., 400V to 800V peak to peak.

Exemplary multipole devices, including ion guides and linear ion traps, that may be employed herein are generally well known in the art (see, e.g., U.S. Pat. Nos. 6,570,153, 6,285,027 and published patent application 20030183759, which publications are incorporated by reference in their entirety).

In use, ions produced by an ion source are introduced into the multipole device via ion entrance 6 where they may be held in the multipole device by a confining RF field. Charged particles are introduced into the multipole device via the ion exit 8, and the charged particles and ions become combined in the ion passageway 19. In certain embodiments, the ions present in the ion passageway after the ions and charged particles have been combined (which may contain the daughter ions of a parental ion or a mixture of ions from different sources) exit the multipole device via the ion exit 8 and enter the mass analyzer 10. Ions entering mass analyzer 10 may be pulsed by pulser 20 towards detector 22 (in certain embodiments via an ion reflector) and are detected thereby.

In order for charged particles to cross mass analyzer 10 and enter the ion exit 8 of the multipole device 4, the charged particles may be propelled (e.g., accelerated) by a voltage differential between the ion source and the exit end of the multipole device. In certain embodiments, therefore, during charged particle transport between the charged particle source and the multipole device, the charged particle source is held at a DC voltage that is either more positive (if positively charged particles are to be transported to the multipole device) or more negative (if negatively charged particles are to be transported to the multipole device) than the DC voltage of the ion exit of the multipole device. While the voltage differential between the multipole device and the charged particle source may vary greatly, positive or negative voltage differentials of about 1 V to about 100 V, e.g., about 5 V to about 50 V or about 10 V to about 25 V are readily employed.

In use of a subject apparatus and in certain embodiments, any voltage applied to the ion exit end of a subject multipole device may be reduced or switched off for a period of time (e.g., about 10 μs to about 1 s, for example, 10 μs to 20 μs, 20 μs to 100 μs, 100 μs to 1 ms, 1 ms to 100 ms or 100 ms to 1,s) to provide an electrical gate that allows the charged particles to pass through the ion exit end and enter the ion passageway of the multipole device. In certain embodiments, the gate may open and close several times per second (e.g., 1 to 10 times per second, for example, 10 to 1000, 1,000 to 10,000, 10,000 to 50,000, 50,000 to 100,000 times per second) to allow charged particles into the multipole device. Since in many cases the charged particles that are introduced into the subject multipole device are smaller and/or have higher energy than the ions already present in the multipole device, such gating, if employed, would allow charged particles to enter the multipole device without causing significant loss of ions from the ion passageway of the multipole device.

Likewise, during the period of time in which charged particles are passing through mass analyzer 10, no voltage is applied to pulser 20. In other words, in certain embodiments, pulser 20 is "off" while the charged particles are passing through mass analyzer 10. Further, when voltage is applied to the pulser 20, i.e., when the pulser is "on" and ions are pulsed through the mass analyzer, the charged particles may be prevented from entering the mass analyzer by any suitable gating device between the source of charged particles 12 and the mass analyzer 10, for example.

In certain embodiments, the subject apparatus is adapted so that the charged particles are ejected by charged particle source 12 into mass analyzer 10 in a direction towards the ion exit of multipole device 4. Mass analyzer 10 may contain ion optical components, e.g., collimating optics, such as a lens or the like, or an ion guide such as a radio frequency multipole or the like, to facilitate movement (e.g., accelerate) of charged particles towards ion exit 8 of multipole device 4. In certain embodiments, the charged particles traverse the mass analyzer as a collimated beam.

In certain embodiments, the subject apparatus is adapted so that the source of charged particles is coaxially aligned with the subject multipole device so that the charged particles are ejected by the charged particle source in a direction that is coaxial with the longitudinal axis of the ion passageway of the subject multipole device. charged particles may be therefore ejected from the ion source to the mass analyzer in a direction that is anti-parallel to the direction of ion movement through the subject multipole device. As illustrated in FIG. 1, the direction of ion movement through a subject multipole device 14 is coaxially opposite to the direction of charged particle movement 16.

The apparatus described above is therefore configured to introduce charged particles into the ion exit end of a subject multipole device. Since the strength of the RF field of the subject multipole device is generally strongest around the rods of the device and weakest at the longitudinal axis of the device, many of the charged particles directed towards the subject multipole device will enter the ion passageway of the device without any exposure to a significant RF field. Accordingly, charged particles entering a subject multipole device according to the invention described herein are not significantly deflected during entry and do not significantly change in energy, unlike charged particles introduced into multipole devices by other means. Accordingly, the subject invention represents a significant contribution to the mass spectrometry arts.

Mass Spectrometry Systems

The subject apparatus may be employed in a variety of mass spectrometry systems that generally contain a primary ion source in addition to the above-described apparatus. The ion source employed in a subject system may be any type of ion source, including, but not limited to a matrix assisted laser desorption ionization source (MALDI) operated in vacuum or at atmospheric pressure (AP-MALDI), an electrospray ionization (ESI) source, a chemical ionization source (CI) operated in vacuum or at atmospheric pressure (APCI) or an inductively coupled plasma (ICP) source, among others. The chemical samples introduced to the ion source may be subjected to a pre-separation with a separation device, such a liquid chromatograph (LC), a gas chromatograph (GC) or an ion mobility spectrometer (IMS).

In one embodiment provided solely to illustrate a representative mass spectrometry system in which a subject apparatus may be employed, the subject apparatus is employed in a tandem mass spectrometer containing an ion source, a mass selector connected to the ion source, a multipole device having an ion entrance end and an ion exit end; a mass analyzer connected to the ion exit end of the multipole device; and a source of charged particles connected to the mass analyzer. The system is configured so that charged particles produced by the source of charged particles pass through the mass analyzer and into the multipole device via its ion exit end. In the above-described example, the multipole device may be utilized as a collision cell.

Figure 3:
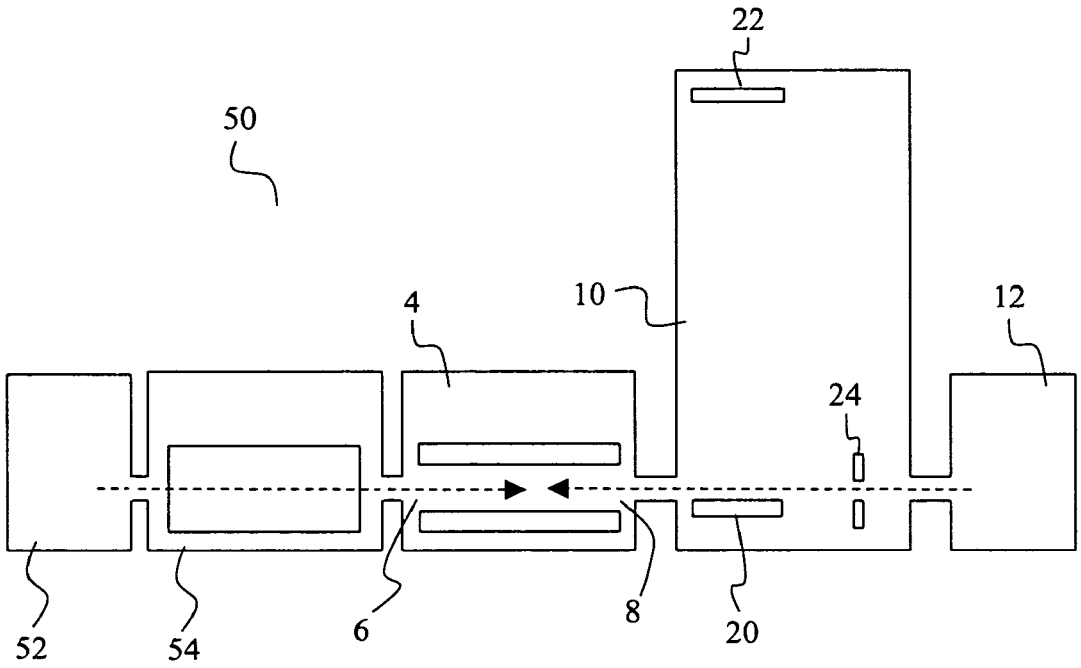
FIG. 3 is a schematic representation of an exemplary mass spectrometer system described in greater detail below.

A representative embodiment of a subject mass spectrometer system is shown in FIG. 3. With reference to FIG. 3, a representative mass spectrometer 50 of the invention may include a primary ion source 52, a mass selector 54, a subject multipole device employed as a collision cell 4, a mass analyzer 10 and a source of charged particles 12. A chemical or biological sample containing analytes is ionized in ion source 52 to produce parent ions. The parent ions are introduced (typically via at least one intermediate vacuum transition stage) into a mass selector 54 (otherwise known as a mass filter) and a particular parent ion (i.e., a parent ion of a particular molecular weight) is selected. The parent ion is transported into collision cell 4 via the ion entrance end of the cell 6 and held within the collision cell, typically in an ion trap. Charged particles are produced in charged particle source 12 and transported through mass analyzer 12 via collimation lens 24 and into the collision cell via the ion exit end of the collision cell 8 using the methods described above. The charged particles are combined with the parent ions in the collision cell. The parent ions and charged particles are maintained for a period of time and the parent ions undergo collision induced fragmentation into daughter ions. The parent ions and daughter ions may further undergo a reaction with charged particles. Such a reaction includes ion recombination, charge transfer or charge reduction or the like. After an appropriate period of time, the daughter ions or reaction products are ejected from collision cell 4 into mass analyzer 10, where they are pulsed by pulser 20 towards detector 22 and are detected. The subject system may contain an optional mass selector between collision cell 4 and mass analyzer 10 in order to filter a particular daughter ion from other daughter ions prior to its introduction into mass analyzer 10.

In certain embodiments, an ion source of a mass spectrometer system may be connected to an apparatus for providing a sample containing analytes to the ion source. In certain embodiments, the apparatus is an analytical separation device such as a gas chromatograph (GC) or a liquid chromatograph (LC), including a high performance liquid chromatograph (HPLC), a micro- or nano-liquid chromatograph or an ultra high pressure liquid chromatograph (UHPLC) device, a capillary electrophoresis (CE), or a capillary electrophoresis chromatograph (CEC) apparatus, however, any manual or automated injection or dispensing pump system may be used. In particular embodiments, a sample may be provided by means of a nano- or micropump, for example.

The invention finds general use in methods of sample mass analysis, where a sample may be any material (including solubilized or dissolved solids) or mixture of materials, typically, although not necessarily, dissolved in a solvent. Samples may contain one or more analytes of interest. Samples may be derived from a variety of sources such as from foodstuffs, environmental materials, a biological sample such as tissue or fluid isolated from a subject (e.g., a plant or animal subject), including but not limited to, for example, plasma, serum, spinal fluid, semen, lymph fluid, the external sections of the skin, respiratory, intestinal, and genitourinary tracts, tears, saliva, milk, blood cells, tumors, organs, and also samples of in vitro cell culture constituents (including but not limited to conditioned medium resulting from the growth of cells in cell culture medium, putatively virally infected cells, recombinant cells, and cell components), or any biochemical fraction thereof. Also included by the term "sample" are samples containing calibration standards or reference mass standards.

Components in a sample are termed "analytes" herein. In certain embodiments, the subject methods may be used to investigate a complex sample containing at least about $10^2$, $5\times10^2$, $10^3$, $5\times10^3$, $10^4$, $5\times10^4$, $10^5$, $5\times10^5$, $10^6$, $5\times10^6$, $10^{78}$, $10^9$, $10^{10}$, $10^{11}$, $10^{12}$ or more species of analyte. The term "analyte" is used herein to refer to a known or unknown component of a sample. In certain embodiments, analytes are biopolymers, e.g., polypeptides or proteins, that can be fragmented into smaller detectable molecules.

All publications and patents cited in this specification are herein incorporated by reference as if each individual publication or patent were specifically and individually indicated to be incorporated by reference. The citation of any publication is for its disclosure prior to the filing date and should not be construed as an admission that the present invention is not entitled to antedate such publication by virtue of prior invention.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

What is claimed is:

1. A method for performing mass spectrometry, comprising:

introducing ions into a multipole device via an ion entrance end of a multipole device;

transporting charged particles through a mass analyzer;

introducing said charged particles into said multipole device via an ion exit end of said multipole device after transporting said charged particles through said mass analyzer to combine said ions and said charged particles in said multipole device and thereby produce daughter ions and/or reactant products;

introducing said daughter ions and/or reactant products into said mass analyzer; and subjecting said daughter ions and/or reactant products to mass analysis in said mass analyzer.

2. The method of claim 1, wherein said charged particles travel through said mass analyzer prior to being introduced into said multipole device.

3. The method of claim 1, wherein said charged particles are produced in a source of charged particles and travel through said mass analyzer prior to being introduced into said multipole device.

4. The method of claim 3, wherein said source of charged particles and said multipole device have a voltage differential.

5. The method of claim 3, wherein voltages applied to said mass analyzer and said multipole device are modulated to allow said charged particles to travel from said source of charged particles to said multipole device.

6. The method of claim 1, wherein said ion entrance end and said ion exit end are axially aligned.

* * * * *